United States Patent [19]

Debruyn, Jr. et al.

[11] 4,247,617

[45] Jan. 27, 1981

[54] SILVER DIFFUSION TRANSFER FILM UNIT TRANSPARENCY

[75] Inventors: Frank E. Debruyn, Jr., Abington; Kenneth G. Scott, Sherborn; Lucretia J. Weed, Boston, all of Mass.

[73] Assignee: Polaroid Corporation, Cambridge, Mass.

[21] Appl. No.: 38,313

[22] Filed: May 11, 1979

Related U.S. Application Data

[63] Continuation-in-part of Ser. No. 865,846, Dec. 30, 1977, abandoned.

[51] Int. Cl.[3] ..... G03C 1/48

[52] U.S. Cl. ..... 430/228; 430/231; 430/233

[58] Field of Search ..... 96/76 R, 110, 80, 87 R, 96/84 R; 430/228, 233, 231, 608, 612

[56] References Cited

U.S. PATENT DOCUMENTS

| | | | |
|---|---|---|---|
| 2,566,245 | 8/1951 | Trivelli et al. | 96/110 |
| 2,597,856 | 5/1952 | Damschroder | 96/110 |
| 2,726,154 | 12/1955 | Land | 430/228 |
| 2,861,885 | 11/1958 | Land | 430/229 |
| 2,944,894 | 7/1960 | Land | 430/228 |
| 3,615,426 | 10/1971 | Debruyn | 430/228 |
| 3,615,427 | 10/1971 | Debruyn | 430/228 |
| 3,615,428 | 10/1971 | Weed | 430/251 |
| 3,672,903 | 6/1972 | Chang | 96/110 |
| 3,674,482 | 7/1972 | Haberlin | 430/228 |
| 3,704,126 | 11/1972 | Land et al. | 96/76 R |
| 3,821,000 | 6/1974 | Land et al. | 96/76 R |
| 3,883,350 | 5/1975 | Charkoudian | 96/110 |
| 3,894,871 | 7/1975 | Land | 430/228 |
| 3,900,323 | 8/1975 | MacLeish et al. | 96/110 |
| 4,056,392 | 11/1977 | Scott | 96/110 |

*Primary Examiner*—Won H. Louie, Jr.
*Attorney, Agent, or Firm*—Philip G. Kiely

[57] ABSTRACT

A silver diffusion transfer film unit comprising a transparent support carrying on one surface, in order, a layer comprising silver precipitating nuclei, a photosensitive silver halide emulsion layer and a layer comprising a processing composition permeable polymer layer, a substantially photoinsensitive, water-insoluble inorganic silver salt and a substantially water-insoluble noble metal compound containing a noble metal below silver in the Electromotive Force Series of Elements. In a preferred embodiment the film unit includes an additive color screen.

10 Claims, 2 Drawing Figures

SILVER DIFFUSION TRANSFER FILM UNIT TRANSPARENCY

CROSS REFERENCE TO OTHER APPLICATIONS

This application is a continuation-in-part of application Ser. No. 865,846, filed Dec. 30, 1977 now abandoned.

BACKGROUND OF THE INVENTION

Additive color reproduction may be produced by exposing a photosensitive silver halide emulsion through an additive color screen having filter media screen elements each an individual additive color such as red, green or blue and by viewing the reversed deposit of silver image formed by transfer to a transparent receiving element through the same or similar screen which is suitably registered with the reverse positive image carried by the receiving layer. As examples of suitable film structures for employment in additive color photography mention may be made of U.S. Pat. Nos. 2,861,885; 2,726,154; 2,944,894; 3,536,488; 3,615,427; 3,615,428; 3,615,429; 3,615,426; 3,894,871; and 3,364,482. Co-pending applications Ser. Nos. 697,104, filed June 17, 1976 and 649,201, filed Jan. 14, 1976 and commonly assigned, also disclose photographic diffusion transfer film units for use in additive color photography.

Co-pending application Ser. No. 383,261, filed July 27, 1973 and commonly assigned is directed to an additive color diffusion transfer film unit which includes a transparent support, an additive multi-color screen, a photosensitive silver halide emulsion layer and a layer comprising an antihalation dye adapted to be discharged as a function of the contact of the layer with photographic processing composition.

U.S. Pat. No. 3,704,126, issued Nov. 28, 1972, discloses and claims photographic silver diffusion transfer processes and film units wherein the positive silver image is provided with enhanced stability by employing in the film unit a noble metal compound, which noble metal is less reactive than silver, that is, below silver in the Electromotive Force Series of Elements. In a preferred embodiment the noble metal compound is an organometal compound which is substantially water insoluble, alkaline solution-soluble and may specifically comprise a compound of the formula M-X, wherein M is a noble metal less reactive than silver and X is an organic complexing ligand which preferably provides a substantially water insoluble complex. The disclosure of U.S. Pat. No. 3,704,126 is incorporated herein by reference in its entirety.

In the above-described film units employed in additive color diffusion transfer processes, a noble metal compound may be disposed in a processing composition permeable layer distal to the support. Thus, the layer comprising the noble metal compound is often located next adjacent the photosensitive silver halide layer.

It has been found, however, that as to silver diffusion transfer film units, employing such noble metal compounds may result in some degree of desensitization of the silver halide emulsion. While not intending to be bound by theory, it is believed that the organic ligand portion of the noble metal compound may contribute to a desensitization effect observed in the silver halide emulsion layer by displacing optical sensitizers on the silver halide grains, but the exact mechanism is not known.

SUMMARY OF THE INVENTION

The present invention is directed to a photographic silver diffusion transfer film unit which comprises, in order, a transparent support, a layer comprising silver precipitating nuclei, a photosensitive silver halide emulsion layer and a layer comprising a substantially photoinsensitive, water-insoluble inorganic silver salt and a substantially water-insoluble noble metal compound containing a noble metal below silver (i.e. more noble than silver) in the Electromotive Force Series of Elements. Preferably, the film unit includes an additive color screen.

DETAILFD DESCRIPTION OF THE INVENTION

Figure 1:
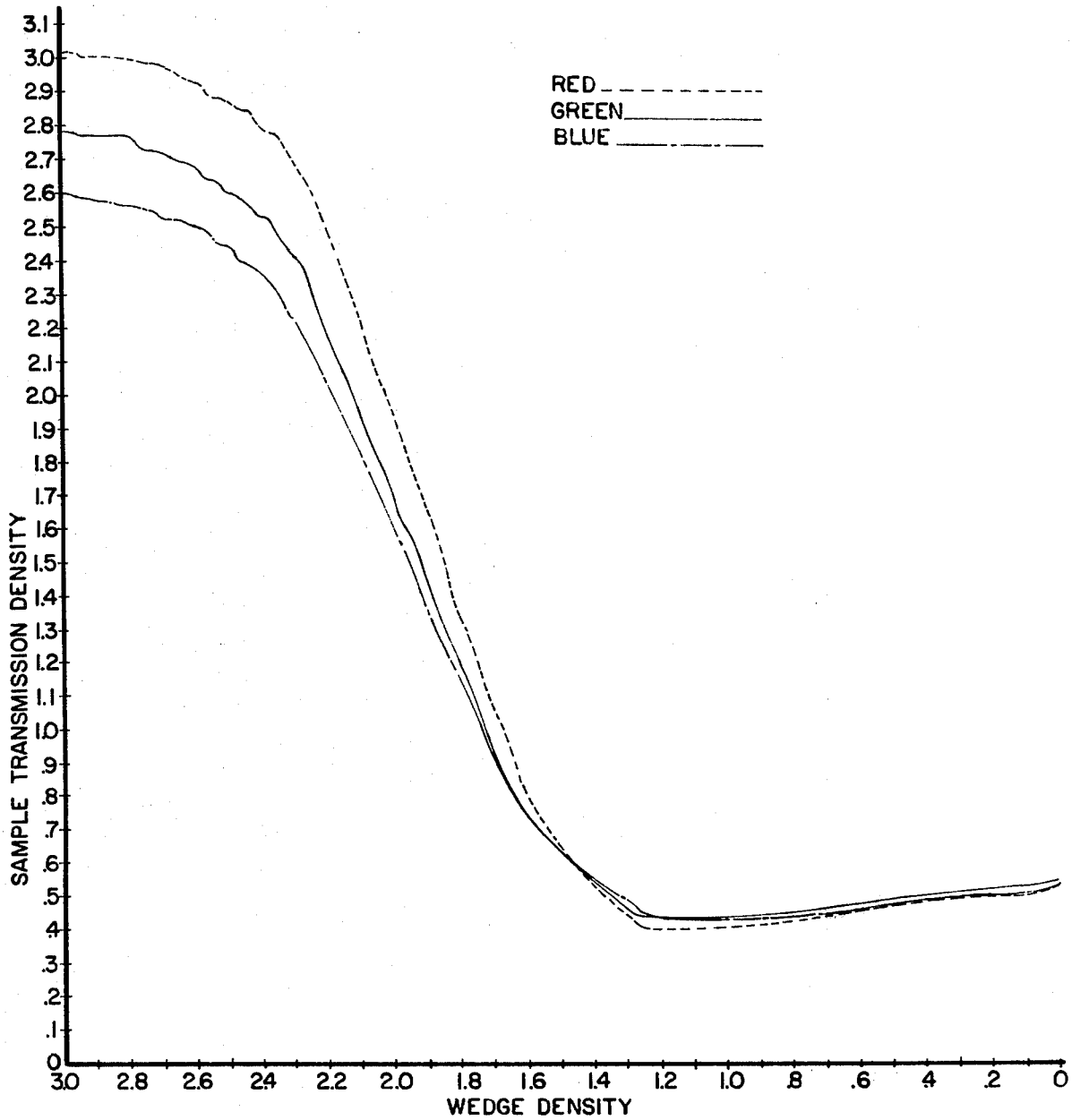
FIGS. 1 and 2 reproduce characteristic curves of the red, green and blue densities of the neutral columns of additive color transparencies obtained in accordance with certain of the examples.

It has been found that in film units of the present invention enhanced storage stability, with respect to the photosensitivity of the silver halide emulsion layer, is obtained by employing, in conjunction with the organometal stabilizing compound, a substantially photoinsensitive, water-insoluble inorganic silver salt.

By the term "substantially photoinsensitive" it is meant that any photosensitivity of the water-insoluble silver salt employed is too low to form an image during photoexposure.

The particular water-insoluble inorganic silver salt employed is not critical. However, care should be taken to avoid employing an anion which might be photographically detrimental to the system. In a preferred embodiment, silver chloride is employed.

An effective amount of substantially photoinsensitive, water-insoluble silver salt is employed. Preferably, a quantity of silver is employed to tie up sufficient ligand from the noble metal compound to minimize or eliminate any appreciable degree of desensitization of the silver halide emulsion. More preferably, about 0.4 mgs Ag/mg Au is employed, although it should be understood that lesser amounts may be employed to obtain a reduced effect. An excess should be avoided to prevent the optical effect of silver from raising the $D_{min}$ in transparencies or to prevent the silver from acting as a nucleating agent.

The effectiveness of the water-insoluble silver salts is also evident from an examination of the H&D curve of film units which only differ in the presence or absence of the salt. Without the substantially photoinsensitive, water-insoluble silver salt, the image is grainy and the H&D curve exhibits a sharp toe. With the substantially photoinsensitive, water-insoluble silver salt, the image is less grainy and the H&D curve exhibits a more desirable toe shape.

The following non-limiting examples illustrate the novel film units of the present invention.

EXAMPLE 1

A film unit was prepared comprising a transparent polyester film base carrying on one surface an additive color screen of approximately 1500 triplets per inch of red, blue and green filter screen elements in a repetitive side-by-side relationship; a 328 mgs/ft$^2$ polyvinylidene chloride-polyvinyl formal protective overcoat layer; a nucleating layer comprising palladium nuclei prepared according to the procedure in Example 8 of application Ser. No. 649,201, filed Jan. 14, 1976 at a coverage of 0.15 mgs/ft$^2$ Pd and 0.19 mgs/ft$^2$ gelatin; an interlayer formed by coating 1.9 mgs/ft$^2$ gelatin; 2.3 mgs/ft$^2$ acetic acid; and 0.19 mgs/ft$^2$ octylphenoxy polyethoxy ethanol surfactant; a hardened gelatino silver iodobromide emulsion coated at a coverage of about 91 mgs/ft$^2$ of gelatin and about 110 mgs/ft$^2$ of silver with about 7.18 mgs/ft$^2$ propylene glycol alginate and about 0.73 mgs/ft$^2$ of nonylphenol polyglycol ether (containing 9.5 moles of ethylene oxide) panchromatically sensitized with 5,5'-diethyl-9-ethyl-3,3'-bis-(3 sulfopropyl)thiacarbocyanine triethyl-ammonium salt (0.53 mg/gAg); 5,5'-diphenyl-9-ethyl-3,3'-bis-(4-sulfobutyl)oxacarbocyanine (0.75 mg/gAg); anhydro-5,6-dichloro-1,3-diethyl-3'-(4''-sulfobutyl)-benzimidazolothiacarbocyanine hydroxide (0.75 mg/gAg); and 3-(3'sulfopropyl)-3'-ethyl-4,5-benzothia-thiacyanine (1.0 mg/gAg); red, green, green and blue sensitizers respectively; and the following antihalo top coat. The antihalo top coat referred to below is disclosed and claimed in copending application Ser. No. 383,261, filed July 27, 1973.

| Top Coat | mgs/ft$^2$ |
|---|---|
| Gelatin | 400 |
| Dow 620 (carboxylated styrene/butadiene copolymer latex Dow Chemical Co., Midland, Michigan) | 204 |
| Propylene glycol alginate | 25.7 |
| Dioctyl ester of sodium sulfosuccinate | 1.2 |
| Benzimidazole-2-thiol gold($Au^{+1}$)complex | 5 (as gold) |
| Daxad-11 (polymerized sodium salts of alkyl naphthalene sulfonic acid) Manufactured by W.R. Grace & Co. Cambridge, Ma. | 0.38 |
| AgIBr (fogged) (0.73μ average mean diameter) | 2 (as silver) |
| Bis,-1,5-[3-(2-hydroxy ethoxy)carbonyl-1-(p-N-n-pentylsulfonamidophenyl)-2-pyrazolin-5-one]-pentamethine oxonol | 5.6 |
| 4-(2-chloro-4-dimethylaminobenzaldehyde)-1-(p-phenylcarboxylic acid)-3-methyl pyrazolone-5 | 7 |

A second film unit was prepared as in Example 1 except that the top coat did not contain the fogged silver iodobromide.

Substantially no desensitization was observed in film units of the present invention compared to the film unit which did not contain the fogged silver iodobromide.

Film units prepared according to the above procedure were given a 16 mcs exposure through the additive color screen and were processed with mechanical lab rollers at a 1.4 mil gap disposing the processing composition set forth below between the top coat and a polyethylene terephthalate cover sheet. The film unit was held in the dark for 1 minute and then the cover sheet was removed, retaining the rest of the film unit together and then air drying.

| Processing Composition | Weight % |
|---|---|
| Sodium hydroxide | 9.4 |
| hydroxyethyl cellulose | 0.7 |

-continued

| Processing Composition | Weight % |
|---|---|
| (sold by Hercules, Inc., Wilmington, Delaware under the tradename Natrasol 250H) | |
| Tetramethyl reductic acid | 9.0 |
| Potassium bromide | 0.6 |
| Sodium sulfite | 0.8 |
| 2-methylthiomethyl-4,6-dihydroxypyrimidine | 9.0 |
| 4-aminopyrazolo-[3,4] pyrimidine | 0.02 |
| N-benzyl-α-picolinium bromide (50% solution) | 2.9 |
| Water | 67.6 |

Figure 2:
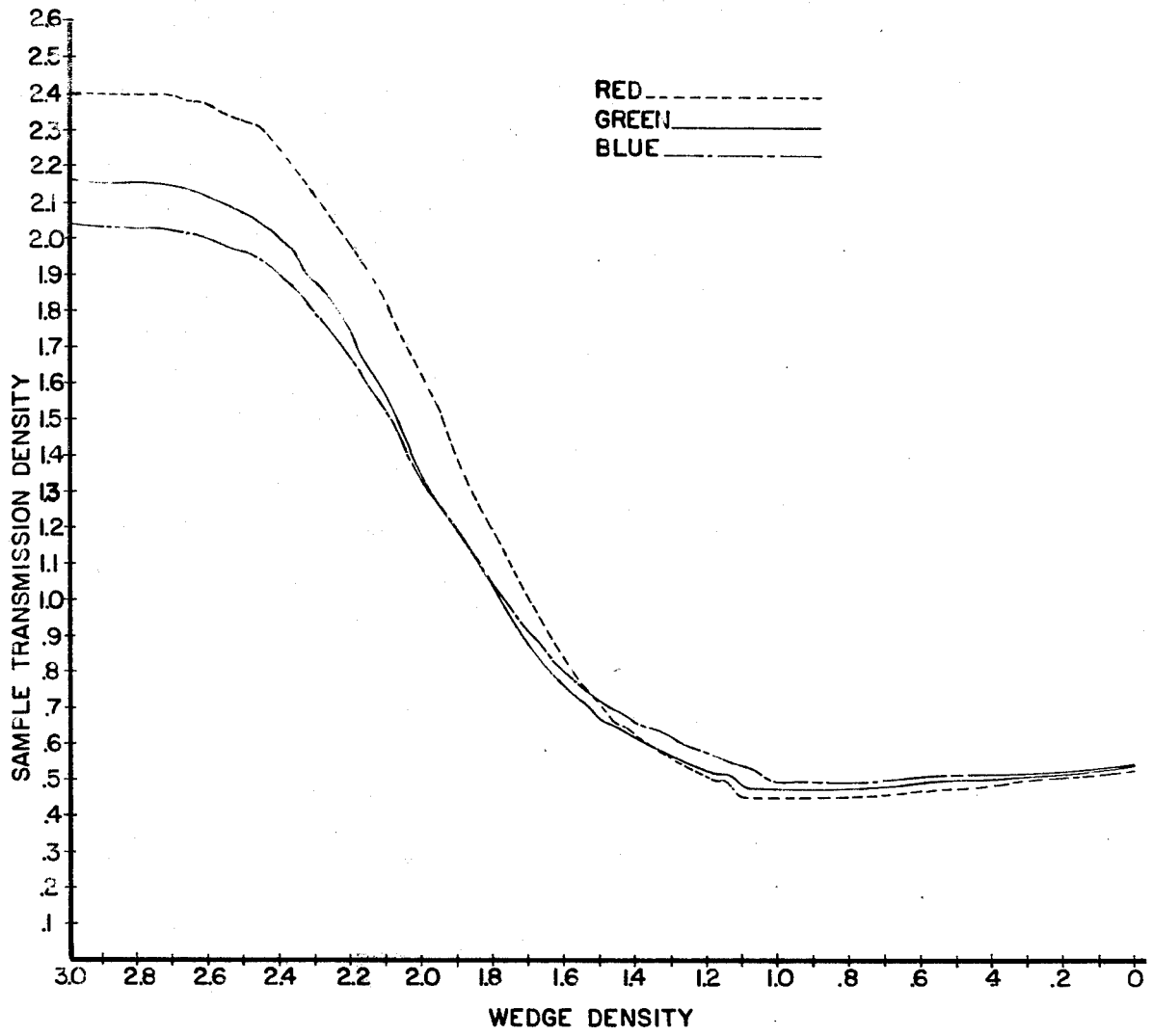
Figure 3:
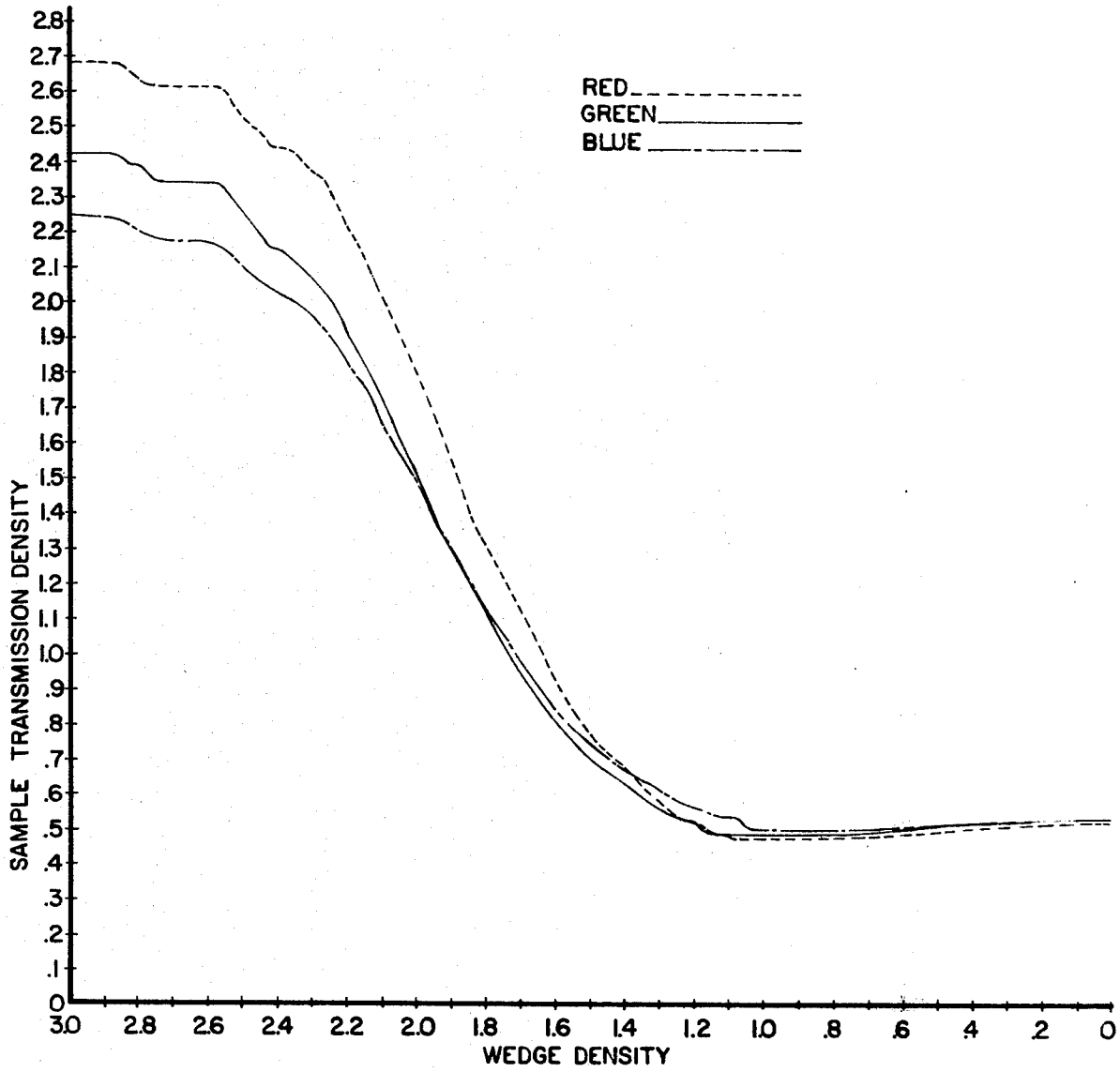

FIG. 1 is the characteristic curve of the control film unit, i.e., the film unit which did not contain silver chloride. FIG. 2 is the characteristic curve of the film unit of Example 1. From a comparison of the curves, it will be seen that in processed film units of the present invention, the image shows a smoother toe shape compared to the control. An examination of the image in film units of the present invention shows less graininess.

The support employed in the present invention is not critical. The support or film base employed may comprise any of the various types of transparent rigid or flexible supports, for example, glass, polymeric films of both the synthetic type and those derived from naturally occurring products, etc. Especially suitable materials, however, comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol terephthalic acid; polymer cellulose derivatives such as cellulose acetate, triacetate, nitrate, propionate, butrate, acetate-butyrate; or acetate propionate; polycarbonates; polystyrenes; and the like.

The additive color screen employed in the present invention may be formed by techniques well known in the art, e.g., by sequentially printing the requisite filter patterns by photomechanical methods. An additive color screen comprises an array of sets of colored areas or filter elements, usually from two to four different colors, each of said sets of colored areas being capable of transmitting visible light within a predetermined wavelength range. In the most common situations, the additive color screen is trichromatic and each set of color filter elements transmits light within one of the so-called primary wavelengths ranges, i.e., red, green and blue. The additive color screen may be composed of minute dyed particles, such as starch grains or hardened gelatin particles, intermixed and interspersed in a regular or random arrangement to provide a mosaic. A regular mosaic of this type may be made by the alternating embossing and doctoring technique described in U.S. Pat. No. 3,019,124. Another method of forming a suitable color screen comprises multiline extrusion of the type disclosed in U.S. Pat. No. 3,032,008, the colored lines being deposited side-by-side in a single coating operation. Still another method is set forth in U.S. Pat. No. 3,284,208. Silver halide solvents useful in forming the desired soluble complex with unexposed silver are well known and, for example, may be selected from the alkali metal thiosulfates, particularly sodium or potassium thiosulfates, or the silver halide solvent may be cyclic imide, such as uracil, in combination with a nitrogenous base as taught in U.S. Pat. No. 2,857,274, issued Oct. 21, 1958, to Edwin H. Land. While the silver halide solvent is preferably initially present in the processing composition, it is within this invention to initially position the silver halide solvent in a layer of the film unit, preferably in the form of a precursor which releases or generates the silver halide solvent upon contact with an alkaline processing fluid.

The processing composition may contain a thickening agent, such as an alkali metal carboxymethyl cellulose or hydroxyethyl cellulose, in a quantity and viscosity grade adapted to facilitate application of the processing composition. The processing composition may be left on the processed film or removed, in accordance with known techniques, as is most appropriate for the particular film use. The requisite alkalinity, e.g., a pH of 12–14, is preferably imparted to the processing composition, such as sodium, potassium and/or lithium hydroxide. A wetting agent may be advantageously included in the processing composition to facilitate application thereof, particularly where the processing composition is applied in a very thin layer of low viscosity fluid.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para- or ortho-positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent(s) should not give rise to colored reaction products which might stain the image or which, either unreacted or reacted, might adversely affect the stability and sensitometric properties of the final image. Particularly useful silver halide developing agents having good stability in alkaline solution are substituted reductic acids, particularly tetramethyl reductic acid, as disclosed in U.S. Pat. No. 3,615,440, issued Oct. 26, 1971 to Stanley M. Bloom and Richard D. Cramer, and $\alpha,\beta$-enediols as disclosed in U.S. Pat. No. 3,730,716, issued to Edwin H. Land, Stanley M. Bloom and Leonard C. Farney on May 1, 1973.

What is claimed is:

1. A silver diffusion transfer film unit comprising a transparent support carrying on one surface, in order, a layer comprising silver precipitating nuclei; a photosensitive silver halide layer and a layer comprising a processing composition permeable polymer, a substantially photoinsensitive, water-insoluble inorganic silver halide salt and a substantially water-insoluble noble metal compound containing a noble metal below silver in the Electromotive Force Series of Elements.

2. The film unit of claim 1 wherein said water-insoluble inorganic silver salt is fogged silver iodobromide.

3. The film unit of claim 2 wherein said noble metal below silver is gold.

4. The film unit of claim 3 wherein said noble metal compound is benzimidazole-2-thiol gold ($Au^{+1}$) complex.

5. The film unit of claim 4 wherein the weight ratio of silver to gold in said processing composition permeable polymer layer is about 0.4 to 1.

6. The film unit of claim 1 which includes an additive color screen.

7. The film unit of claim 1 wherein said silver precipitating nuclei are noble metal nuclei.

8. The film unit of claim 7 wherein said noble metal nuclei are palladium.

9. The film unit of claim 1 wherein said processing composition permeable polymer comprises gelatin.

10. The film unit of claim 9 wherein said processing composition permeable polymer layer includes a processing composition dischargeable antihalation dye.

* * * * *